US010625286B2

(12) United States Patent
Detsch et al.

(10) Patent No.: US 10,625,286 B2
(45) Date of Patent: Apr. 21, 2020

(54) PORTABLE REFILLABLE LIQUID DISPENSER

(71) Applicant: Heinz Glas USA, Inc., Linden, NJ (US)

(72) Inventors: Armin Detsch, Reichenbach (DE); Alexander Heinz, Sonneberg (DE)

(73) Assignee: Heinz-Glas USA Inc., Linden, NJ (US)

( * ) Notice: Subject to any disclaimer, the term of this patent is extended or adjusted under 35 U.S.C. 154(b) by 155 days.

(21) Appl. No.: 15/656,064

(22) Filed: Jul. 21, 2017

(65) Prior Publication Data

US 2018/0029058 A1 Feb. 1, 2018

(51) Int. Cl.

| | |
|---|---|
| ***B05B 11/00*** | (2006.01) |
| ***B67D 7/42*** | (2010.01) |
| ***B67D 7/02*** | (2010.01) |

(52) U.S. Cl.

CPC ..... *B05B 11/0097* (2013.01); *B05B 11/3045* (2013.01); *B67D 7/0205* (2013.01); *B67D 7/0288* (2013.01); *B67D 7/42* (2013.01)

(58) Field of Classification Search

CPC .. B67D 7/0288; B67D 7/0294; B67D 7/0205; B67D 7/42; B05B 11/0097; B05B 11/3045

See application file for complete search history.

(56) References Cited

U.S. PATENT DOCUMENTS

| | | | | | |
|---|---|---|---|---|---|
| 3,223,289 | A * | 12/1965 | Bouet | A45D 40/00 | 222/209 |
| 3,419,172 | A * | 12/1968 | Lee | B65D 1/0238 | 215/44 |
| 3,595,279 | A * | 7/1971 | Jaffe | B65B 3/04 | 141/114 |
| 4,347,879 | A * | 9/1982 | Blaser | B65D 71/502 | 141/364 |
| 5,462,101 | A * | 10/1995 | Mouchmouchian | A61J 7/0023 | 141/18 |
| 6,418,987 | B1 * | 7/2002 | Colasacco | B65B 39/001 | 141/319 |
| 8,540,100 | B1 * | 9/2013 | Lee | B65D 55/00 | 141/319 |
| 2008/0223479 | A1 * | 9/2008 | Bassett | A47K 5/12 | 141/2 |
| 2014/0010582 | A1 * | 1/2014 | Arminak | B05C 1/00 | 401/213 |

* cited by examiner

*Primary Examiner* — Andrew D StClair

(74) *Attorney, Agent, or Firm* — Chan Hubbard PLLC; Keata Chan

(57) ABSTRACT

Disclosed herein is a portable liquid dispenser, preferably for perfume or the like, which can be easily refilled. Many portable perfume dispensers are disposable instead of being refillable. We have invented a system that has all of the functionality of a portable dispenser—such as an atomizer or a roll-on applicator—but also provides access so that the dispenser is easily refilled from a larger container. Therefore, we have also invented a method for refilling a portable liquid dispenser.

8 Claims, 1 Drawing Sheet

PORTABLE REFILLABLE LIQUID DISPENSER

CROSS-REFERENCE TO RELATED APPLICATION

This invention claims priority to German patent applications 10 2016 113 754.5 and 10 2016 113 755.3, each filed on Jul. 26, 2017.

BACKGROUND OF THE INVENTION

The invention relates to a portable refillable liquid dispenser. Furthermore, the invention relates to a system consisting of such a liquid dispenser and a storage container with a spray mechanism. Finally, the invention relates to a method to refill such a liquid dispenser.

Perfumes and similar products are often sold in bottles with contents of 50 ml, 100 ml or more. These sizes are not conceived to be transported as needed, e.g. in a handbag.

In addition, small receptacles are also known, such as travel vials with contents of 5 ml or 10 ml, for example, only intended for a few applications, or sample bottles often in the form of a vial with contents of 0.7 ml or 1.5 ml that are exclusively intended for trials.

In many cases, the desire exists to refill such small receptacles in order to reuse them.

In the case of sample vials, refilling can be ruled out in most cases because the opening of the bottle is too small to do so. Moreover, such sample vials are not well suited for the intended purpose of use, because they do not have any dispensing device whatsoever, such as a spray or rolling head.

In contrast, travel vials, whose opening is often large enough to be refilled, are frequently not equipped for this purpose. Normally, the bottle opening is not accessible or can only be accessed with difficulty, because the dispensing device is firmly connected to the [bottle]. A spray or rolling head or the like would first have to be removed with the aid of a tool, such as pliers.

In addition, most perfume bottles that can basically serve as refill or storage containers for such a portable refillable liquid dispenser are equipped with an atomizer mechanism and are therefore hard to open. They are therefore not suited as a storage container to refill a travel vial.

BRIEF SUMMARY OF THE INVENTION

One task of the present invention is to make it possible to refill a portable liquid dispenser with a simple and cost-effective design, particularly for perfume or the like. In particular, small receptacles, such as travel vials or the like, should be refillable with little effort using commercially available containers with a spray pump as a storage container, for example using a conventional perfume bottle.

This task is solved through a liquid dispenser according to Claim 1. Advantageous embodiments of the invention are specified in the subclaims. The advantages and embodiments explained below in connection with the liquid dispenser also apply analogously to the system according to the invention and to the method according to the invention and vice versa.

According to the invention, the portable refillable liquid dispenser, particularly for perfume or the like, is characterized by having a receptacle, particularly a bottle or the like, whereby the receptacle has an opening, a dispensing device, particularly a dispensing device allocated to the opening, to remove the liquid from the container through the opening, and a removable cap to cover the dispensing device, whereby the dispensing device, preferably without any tool, i.e. only by hand, is connected detachably to the container, and whereby the cover cap can be connected to the container, preferably directly, when the dispensing device is removed, and whereby the cover cap has a refill opening through which liquid can be filled into the receptacle when the cover cap is connected to the container, and whereby the refill opening is designed to receive a spray tube, particularly to receive a spray tube from a conventional container with a spray mechanism.

According to the invention, the method for refilling a portable liquid dispenser, particularly for perfume or the like, is characterized by the following steps: a dispensing device for removing liquid from a container of the liquid dispenser is separated from the container; a cap to cover the dispensing device is separated from the dispensing device and connected to the container; a spray tube from a storage container placed into a refill opening provided in the cover cap and liquid is transferred from the storage container into the container of the liquid dispenser.

A basic idea of the invention is to execute the receptacle of the liquid dispenser in two parts, namely so that the dispensing device can be removed from the receptacle. This is done particularly in such a way that the opening of the receptacle, to which the dispensing device was previously allocated, is freed after removing the dispensing device. The receptacle in other words has a removable dispenser head. By means of this first inventive step, the receptacle opening, through which liquid is removed from the receptacle when the dispensing is assembled, preferably becomes freely accessible or at least accessible so that the further refill procedure described in detail below can be carried out.

Thus, while in the prior art, the dispensing device is firmly connected to the receptacle and/or can only be separated from the receptacle using a tool, a detachable connection of the dispensing device and receptacle is provided according to the invention from the outset.

A further basic idea of the invention is that the cover cap detachable from the dispensing device can be connected to the receptacle when the dispensing device has been removed, this cover cap having a refill opening according to the invention which is designed to receive a spray tube through which the refilling takes place.

In a preferred embodiment of the invention, the cover cap can be connected to the receptacle instead of the dispensing device. This means that the cover cap takes the place of the dispensing device. When the dispensing device is removed, the cover cap can thus be connected directly to the receptacle.

In a preferred embodiment of the invention, the receptacle can be filled through the opening when the cover cap is connected with the receptacle. This means that the removal and refilling of the receptacle are carried out through one and the same opening. His makes it particularly easy to handle the liquid dispenser during refilling.

In a preferred embodiment of the invention, this opening is the only opening of the receptacle. Because only a single opening is required in this case, the receptacle of the liquid dispenser can be particularly simple. Moreover, where there is only one opening, the receptacle only requires a single means of fastening to bring about a detachable connection to the dispensing device or cover cap, which may be a simple screw connection. In the simplest case, the receptacle is a bottle, with a connecting thread provided on the bottleneck.

No special, structurally complicated mechanical connection is necessary between the dispensing device and the receptacle.

In a preferred embodiment of the invention, both the dispensing device and the cover cap can each be connected with the receptacle by means of a first type of connection, particularly by means of a screw connection. Particularly advantageous in this connection has proven an embodiment of the invention in which the cover cap can be connected to the dispensing device by means of a second type of connection different from the first type of connection, particularly by means of a latching, snap-in or plug connection. In other words, the cover cap preferably has a means to form two different connections.

In a preferred embodiment of the invention, the dispensing device and cover cap and the receptacle have identical or equivalent (though at least compatible) means of connection. In addition, the cover cap preferably has a type of connection different from these. In this case, the cover cap thus has on the one hand a first type of connection for normal use, in which the cover cap is connected to the dispensing device, and on the other a second type of connection to connect the cover cap to the receptacle for the refilling process. Preferably, the two types of connections differ from each other through different opening movements, preferably such that when executing an opening movement for separating the one type of connection an opening movement for the other type of connection cannot be executed unintentionally. This can be realized particularly advantageously when the cover cap for removing the dispensing device is withdrawn, for example, in the longitudinal direction of the receptacle, while an exchange of the head part of the liquid dispenser for refilling (i.e. removing the dispensing device or mounting the cover cap directly on the receptacle) takes place by screwing on or off, i.e. a screw movement around the central longitudinal axis of the receptacle.

In a preferred embodiment of the invention, the dispensing device has a roll mechanism to distribute the liquid. In another embodiment of the invention, the dispensing device has a spray mechanism to atomize the liquid. If, as in the preferred embodiment, the dispensing device is a rolling head, then, to distribute the liquid, the rolling head has a ball enclosed in a socket that can rotate therein, one part of the ball being in contact with the liquid, while the other part of the ball is directed outwards serving to apply the liquid. Instead of such a rolling head, however, the dispensing device can also be executed as a spray head. In this case, a tube that can be placed in the liquid and a pump that is connected to the tube are provided, the pump being equipped with a nozzle through which the liquid can be sprayed.

In a preferred embodiment of the invention, the receptacle of the liquid dispenser is a bottle, preferable of glass and/or a plastic material.

The liquid dispenser according to the invention is preferably designed in such fashion that it contains liquid for a few applications. In preferred embodiment of the invention, the receptacle has contents of less than 15 ml. Typically, the receptacle has contents of 5 ml or 10 ml. In contrast, a spray bottle used as a refill or storage container can have contents of 50 ml, 100 ml or more, for example.

The invention is particularly advantageous for use with liquids such as perfume, aftershave or the like. The liquid to be delivered is not limited to perfume. It is also possible to use other liquids. In this connection, the design of the delivery or dispensing device is not limited to spray or roll mechanisms. It is also possible to use other dispensing technologies. In the simplest case, the dispensing device and the receptacle can be closed with a simple twist lock or the like. The refill opening is then provided in this closing element.

In a preferred embodiment of the invention, a refill mechanism is provided instead of a simple refill opening. This means that not only a single opening, but further structural elements, which can be movable or immovable, are provided to refill the receptacle. In one variant, such a refill mechanism has several channels, e.g. one refill channel and a separately extending ventilation channel, through which the emerging air can escape outwards from the inside of the receptacle and/or into the interior of the refill container. In another variant, a refill mechanism comprises a means of connection suited to form a detachable connection between the refill container and the receptacle. In this case, this connection is not only realized by plugging the spray tube in the refill opening. Instead, an additional mechanical connection can be provided to secure the receptacle to the refill container or vice versa during the refilling process, e.g. a screw connection, for which purpose at least the cover cap and/or if necessary the refill container, has a suitable means of connection.

With the aid of the present invention, by providing the refill opening, it is possible in a particularly simple way to use a conventional perfume bottle with a common spray mechanism to refill a travel vial or the like. The refill opening is designed for this purpose precisely to accommodate a spray tube, particularly a spray tube from a commercial available spray mechanism.

The spray button is removed from the perfume bottle serving as the storage container, so that the spray tube, i.e. the shaft (hollow shaft) of the spray mechanism, is free. The tube is then pressed against the cover cap so that it penetrates the refill opening. Preferably, this pushing movement simultaneously actuates the spray valve of the storage container and liquid, e.g. perfume, enters the receptacle of the liquid dispenser from the storage container. After a few such pumps (pumping movements), the filling process is over and the liquid dispenser and storage container are separated from each other against by pulling the spray tube out from the refill opening in the cover cap.

In addition to the previously described advantages, a further advantage of the solution according to the invention is that, to use a conventional spray bottle or another liquid container with a spray pump as a refill container, no adapter piece or the like which must be kept and transported separately from the liquid dispenser is required. The refill opening needed for refilling by means of the spray tube is instead provided in the cover cap, in other words integrated into the liquid dispenser. It can therefore not be lost.

The invention enables the refilling of a portable liquid dispenser in a structurally simple and cost-effective fashion. Small receptacles, such as travel vials or the like, can be refilled with little effort using commercially available containers with a spray pump as a storage container, for example using a conventional perfume bottle.

The invention provides a portable refillable liquid dispenser that can be filled from a conventional bottle with a spray mechanism. Such a liquid dispenser can preferably be used in the form of a travel vial for perfume. Because it is refillable, liquid from a conventional bottle with a spray mechanism can be filled through the refill opening when the cover cap is mounted directly on the receptacle. If the dispensing device is instead connected to the receptacle, the liquid is removed, as in the case of a conventional liquid dispenser, through the dispensing device and the cap serves to cover the dispensing device.

BRIEF DESCRIPTION OF THE DRAWINGS

An exemplary embodiment of the invention is explained in detail below based on the drawings. In this regard.

All figures show the invention not to scale but only schematically and with their essential components. Identical reference symbols correspond to elements with the same or comparable function.

DETAILED DESCRIPTION OF THE INVENTION

Figure 1:
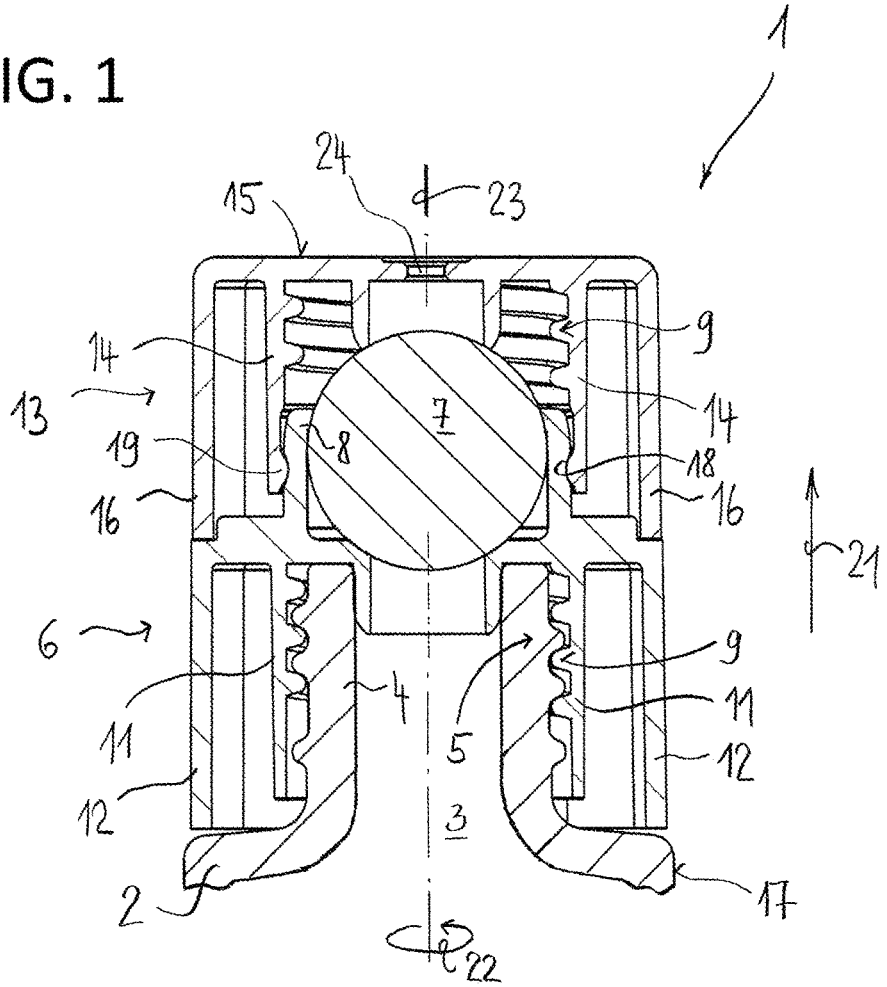
FIG. 1 shows the upper end of a liquid dispenser according to the invention in the closed state of use in a sectional view.

The upper portion of a portable refillable liquid dispenser 1 for perfume is shown in its state of use in FIG. 1. The dispenser 1 comprises a receptacle 2 in the form of a glass bottle, for example with contents of 5 ml. The cross-section of the glass bottle 2 can be circular or oval, for example. The glass bottle 2 is of a pin-shaped design, for example.

The receptacle 2 has a single opening 3 on its upper end. The bottleneck 4 of the glass bottle 2 has a connecting thread 5. Attached to this is a dispensing device 6 to remove the perfume from the receptacle 2 through the opening 3. The dispensing device 6 is a rolling head to distribute perfume. The roll mechanism comprises a plastic or glass ball 7, which is enclosed in a socket 8 of the rolling head 6 and can rotate within this socket 8. The fit between the ball 7 and the socket 8 is selected so that the ball 7 can transport a layer of perfume outwards through its rotating movement, while being held in the socket 8. Part of the ball 7 has contact with the inside part of the bottle 2, another part with the outside environment. The outwardly directed part of the ball 7 can apply and distribute the perfume, for example, directly on the skin, after the ball 7 has been previously wetted with perfume inside the receptacle 2.

As previously noted, the dispensing device 6 need not be a rolling head and may be any type of mechanism to distribute perfume, such as a spray head, without deviating from the spirit of the invention. In this case, a tube that can be placed in the liquid and a pump that is connected to the tube are provided, the pump being equipped with a nozzle through which the liquid can be sprayed.

The counterthread 8 required for the connection to the bottleneck 4 is affixed inside an assembly mandrel 11 of the rolling head 6, provided opposite the socket 8. An outer casing 12 surrounds the area of the assembly mandrel 11, forming a panel that at the same time serves as visual protection.

Figure 2:
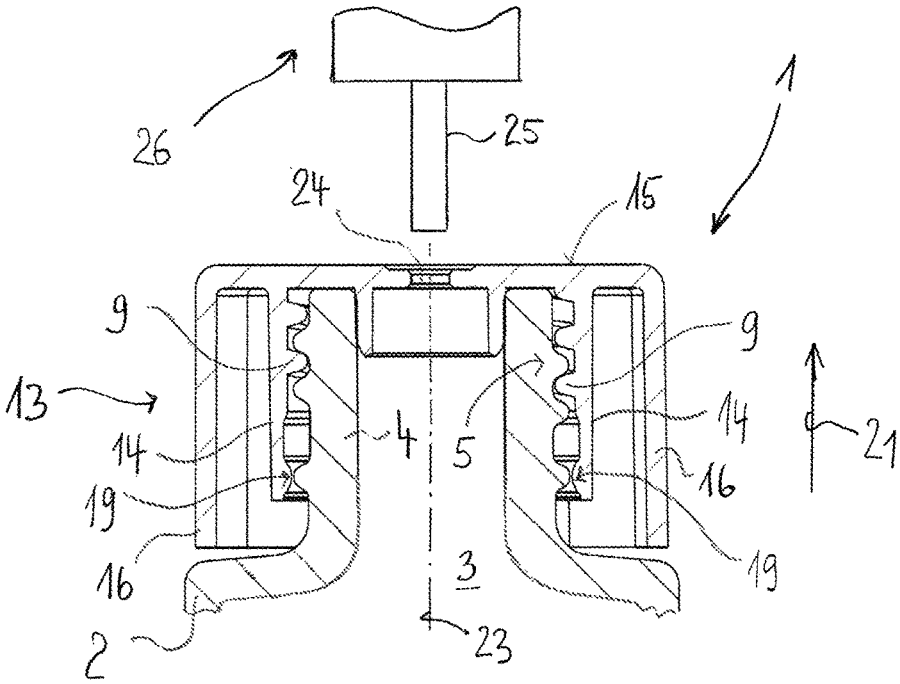
FIG. 2 shows the upper end from FIG. 1, though with a cover cap directly attached to the bottle for refilling, in a sectional view.

The dispenser 1 moreover comprises a cap 13 to cover the rolling head 6. The cover cap 13 can be removed from the dispensing device 6. The dispensing device 6 is detachably connected to the receptacle 2, and can thus be unscrewed. When the dispensing device 6 is removed, the cover cap 13 can be connected to the receptacle 2 instead of the dispensing device 6, as shown in FIG. 2. For this purpose, the cover cap 13 has a suitable screw thread. This is also embodied as a counterthread 9 to the connection with the threads 5 on the bottleneck 4 and is arranged inside a connecting mandrel 14 that extends away from the flat top 15 of the cover cap 13. Here, too, an outer casing 16 encompasses the area of the connecting mandrel 14 and foams a panel that at the same time serves as visual protection. Preferably, the two outer shells 12, 16 of the dispensing device 6 and cover cap 13 align with each other in the operating state (FIG. 1) and moreover serve to provide an imaginary extension of the outside 17 of the receptacle 2 until the top 15 of the cover cap 13, resulting as a whole in an optically continuous body for dispenser 1.

The cover cap 13 is placed on the dispensing device 6 when in a closed state by forming a latching connection. For this purpose, the dispensing device 6 has a circumferential groove 18 on the outside of the socket 8 holding the ball 7 and the cover cap 13 has a bead 19, which runs at the free end of the connecting mandrel 14 and corresponds to the groove 18, to engage the groove 18.

In the normal operating state (FIG. 1), the screw thread 9 of the cover cap 13 has no function. The cover cap 13 can be placed onto the dispensing device 6 or removed from the dispensing device 6 in the longitudinal direction of the bottle 21. If the dispenser 1 is to be refilled, the cover cap 13 can be screwed together at the location of the dispensing device 6 with the receptacle 2 (screw movement 22 around the central longitudinal axis 23 of the bottle 2).

In the center of its top 15, the cover cap 13 has a refill opening 24, through which the liquid can be filled into the receptacle 2 when the cover cap 13 is attached to the receptacle 2 (FIG. 2). This refill opening 24 is designed to receive a spray tube 25 of a storage container. A commercially available perfume bottle 26, e.g. with contents of 100 ml, which has a standard pump spray mechanism (not depicted), serves as a storage container. After the spray button of this perfume bottle 26 has been removed, which is usually possible by simply peeling it off, the spray tube 25 of the perfume bottle 26 is free and can be inserted into the refill opening 24. When the spray tube 25 has been introduced into the refill opening 24, perfume can be transferred from the perfume bottle 26 through the opening 24 into the receptacle 2 by pumping several times. The otherwise closed top 15 of the cover cap 13 serves as a mechanical stop and counter-bearing for the perfume bottle 26 to operate the spray valve (not depicted) of the perfume bottle 26.

A refillable dispenser 1, which can be filled several times, is thus provided. For refilling, the ball 7 need not be removed from its socket 8, nor does an additional refill opening or the like have to be provided in the receptacle 2.

In order to make it possible to refill a portable liquid dispenser (1) with a simple and cost-effective design, particularly for perfume or the like, a method with the following steps is proposed: a dispensing device (6) to remove the liquid from a receptacle (2) of the liquid dispenser (1) is separated from the receptacle (2); a cap (13) to cover the dispensing device (6) is separated from the dispensing device (6) and connected to the receptacle (2); a spray tube (25) from a storage container is placed in a refill opening (24) provided in the cover cap (13); and liquid is transferred from the storage container (26) into the receptacle (2) of the liquid dispenser (1).

The invention claimed is:

1. A portable refillable liquid dispenser (1) for perfume, comprising:

a receptacle (2) having an opening (3), a dispensing device (6) for removing the liquid from the receptacle (2) through the opening (3), and a removable cover cap (13) to cover the dispensing device (6), wherein:

the dispensing device (6) is detachably connected to the receptacle (2), the cover cap (13) can be connected to the receptacle (2) when the dispensing device (6) has been removed, the receptacle (2) comprises screw threads (5) on its outer surface capable of receiving both the dispensing device (6) and the cover cap (13), the cover cap (13) has a refill opening (24), through which the liquid can be filled into the receptacle (2) when the cover cap (13) is connected to the receptacle (2), the refill opening (24) being designed to receive a spray tube (25) from a storage container (26), and the cover cap (13) has threads for detachably connecting to screw threads of the receptacle (2), and has a latching, snap-in, or plug-in connection (18, 19) which connects to the dispensing device.

2. Liquid dispenser (1) according to claim 1, in which the receptacle (2) can be filled through the opening (3) when the cover cap (13) is connected to the receptacle (2).

3. Liquid dispenser (1) according to claim 1, in which the opening (3) is the only opening of the receptacle (2).

4. Liquid dispenser (1) according to claim 2, in which the opening (3) is the only opening of the receptacle (2).

5. System consisting of a liquid dispenser (1) according to claim 1 and a storage container (26) with a spray mechanism that has a spray tube (25).

6. System consisting of a liquid dispenser (1) according to claim 2 and a storage container (26) with a spray mechanism that has a spray tube (25).

7. System consisting of a liquid dispenser (1) according to claim 3 and a storage container (26) with a spray mechanism that has a spray tube (25).

8. System consisting of a liquid dispenser (1) according to claim 4 and a storage container (26) with a spray mechanism that has a spray tube (25).

* * * * *